US011325150B2

(12) United States Patent
Matsumoto

(10) Patent No.: US 11,325,150 B2
(45) Date of Patent: May 10, 2022

(54) SEALANT DISCHARGING NOZZLE AND SEALANT DISCHARGING APPARATUS

(71) Applicant: SUBARU CORPORATION, Tokyo (JP)

(72) Inventor: Yohei Matsumoto, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 240 days.

(21) Appl. No.: 16/590,633

(22) Filed: Oct. 2, 2019

(65) Prior Publication Data

US 2020/0114386 A1 Apr. 16, 2020

(30) Foreign Application Priority Data

Oct. 11, 2018 (JP) ..... JP2018-192789

(51) Int. Cl.
*B05C 5/02* (2006.01)
*B05B 13/04* (2006.01)
*E04F 21/165* (2006.01)

(52) U.S. Cl.
CPC ..... *B05C 5/0212* (2013.01); *B05B 13/0431* (2013.01); *E04F 21/1655* (2013.01)

(58) Field of Classification Search
CPC ... E04F 21/1655; E04F 21/1652; E04F 21/16; E04F 21/161
See application file for complete search history.

(56) References Cited

U.S. PATENT DOCUMENTS 3,559,234 A * 2/1971 Swayze ..... B05C 17/00516 425/182
4,074,655 A 2/1978 Gross et al.
2008/0135650 A1 6/2008 Starke
2008/0264981 A1 10/2008 Hjort
2015/0044369 A1 2/2015 Keener et al.
2016/0114350 A1 4/2016 Brodbeck et al.
2017/0008024 A1* 1/2017 Weinmann ..... B05C 5/0208
2017/0246654 A1 8/2017 Pringle, IV et al.

FOREIGN PATENT DOCUMENTS

DE 299 11 294 U1 10/1999
DE 202013003380 U1 * 5/2013 ..... B05C 17/00516
EP 2942109 A1 * 11/2015 ..... B05C 17/00516
(Continued)

OTHER PUBLICATIONS

English translation for EP2942109A1.*
(Continued)

*Primary Examiner* — Charles Capozzi
(74) *Attorney, Agent, or Firm* — Troutman Pepper Hamilton Sanders LLP

(57) ABSTRACT

A sealant discharging nozzle includes a nozzle body, a through hole, a discharge port, and a cutout. The through hole is provided in the nozzle body and extends along a central axis of the nozzle body. The discharge port is an opening of the through hole provided in an end surface of the nozzle body. Compared with a width of the discharge port in a first direction orthogonal to the central axis, a width of the discharge port in a second direction orthogonal to the central axis and the first direction is small. The cutout is formed on a first side in a first direction with respect to the discharge port.

6 Claims, 13 Drawing Sheets

(56) References Cited

FOREIGN PATENT DOCUMENTS

| | | | |
|---|---|---|---|
| JP | 2015-36145 | A | 2/2015 |
| WO | 2012/025748 | A1 | 3/2012 |

OTHER PUBLICATIONS

English translation for DE202013003380U1.*
Partial European Search Report issued in corresponding European Patent Application No. 19 20 2422 dated Apr. 15, 2020.
Extended European Search Report issued in corresponding European Patent Application No. 19 20 2422 dated Sep. 10, 2020.

* cited by examiner

SEALANT DISCHARGING NOZZLE AND SEALANT DISCHARGING APPARATUS

CROSS-REFERENCE TO RELATED APPLICATIONS

The present application claims priority from Japanese Patent Application No. 2018-192789 filed on Oct. 11, 2018, the entire contents of which are hereby incorporated by reference.

BACKGROUND

The present disclosure relates to a sealant discharging nozzle and a sealant discharging apparatus.

Japanese Unexamined Patent Application Publication No. 2015-36145 discloses a sealant discharging apparatus that uses a robot arm to apply sealant to a corner formed between two members.

SUMMARY

An aspect of the disclosure provides a sealant discharging nozzle including a nozzle body, a through hole, a discharge port, and a cutout. The through hole is provided in the nozzle body and extends along a central axis of the nozzle body. The discharge port is an opening of the through hole provided in an end surface of the nozzle body. Compared with a width of the discharge port in a first direction orthogonal to the central axis, a width of the discharge port in a second direction orthogonal to the central axis and the first direction is small. The cutout is formed on a first side in a first direction with respect to the discharge port.

Another aspect of the disclosure provides a sealant discharging apparatus including the sealant discharging nozzle described above, a holding device to and from which the sealant discharging nozzle is attachable and detachable, a driving device coupled to the holding device, and an engaging pin configured to be attached to the holding device, the engaging pin being capable of engaging with an engaging groove of the sealant discharging nozzle.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
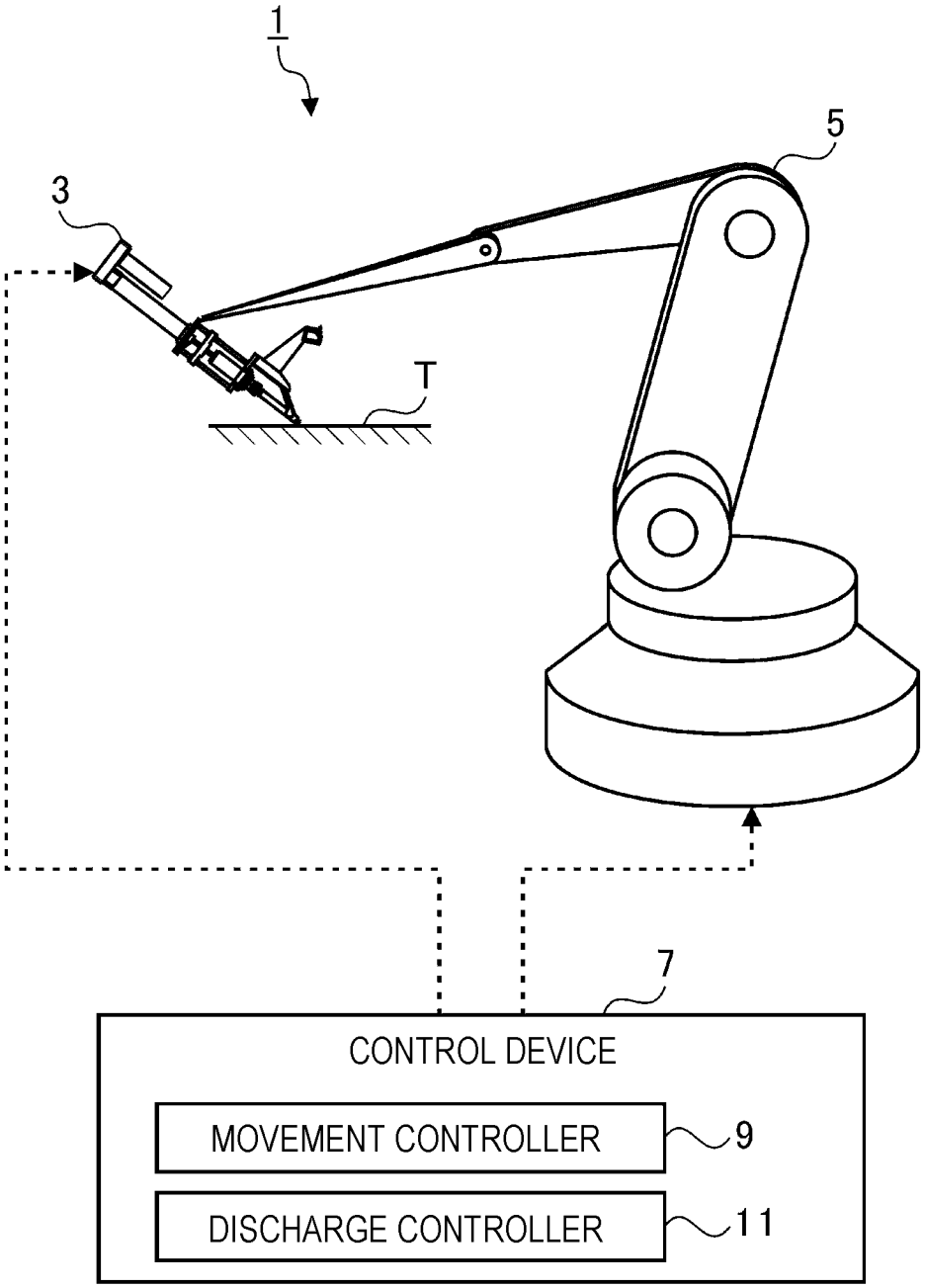
FIG. 1 is a diagram illustrating a configuration of a sealant discharging apparatus according to an embodiment of the disclosure.

In the following, a preferred but non-limiting embodiment of the disclosure is described in detail with reference to the accompanying drawings. Note that sizes, materials, specific values, and any other factors illustrated in the embodiment are illustrative for easier understanding of the disclosure, and are not intended to limit the scope of the disclosure unless otherwise specifically stated. Further, elements in the following example embodiment which are not recited in a most-generic independent claim of the disclosure are optional and may be provided on an as-needed basis. Throughout the present specification and the drawings, elements having substantially the same function and configuration are denoted with the same reference numerals to avoid any redundant description. Further, elements that are not directly related to the disclosure are unillustrated in the drawings. The drawings are schematic and are not intended to be drawn to scale. Typically, when applying a narrow-bead sealant, a nozzle having a circular discharge port with a small diameter is used. However, a nozzle with a circular discharge port with a small diameter has a large pipeline resistance and it is difficult to control the discharge amount of the sealant. Accordingly, workability in applying the sealant has been low.

It is desirable to provide a sealant discharging nozzle and a sealant discharging apparatus that are capable of improving the workability in applying the sealant.

FIG. 1 is a diagram illustrating a configuration of a sealant discharging apparatus 1. Note that a flow of a signal is indicated by a broken line arrow in FIG. 1.

As illustrated in FIG. 1, the sealant discharging apparatus 1 includes a seal gun (a holding device) 3, a robot arm (a driving device) 5, and a control device 7. Based on control of the control device 7, the seal gun 3 applies sealant on an object T. Note that a configuration of the seal gun 3 will be described later in detail.

The robot arm 5 includes a plurality of joints and the seal gun 3 is coupled to a leading end of the robot arm 5. An actuator is provided in each joint of the robot arm 5. Based on control of the control device 7, the robot arm 5 drives the actuators to move the seal gun 3 to an optional position at an optional speed.

The control device 7 is a microcomputer including a central processing unit (CPU), a ROM in which a program and the like are installed, a RAM serving as a work area, and the like. The control device 7 expands and executes the program, which is stored in the ROM, on the RAM so as to function as a movement controller 9 and a discharge controller 11.

The movement controller 9 drives and controls the actuators provided in the joints of the robot arm 5. With the above, the robot arm 5 can move the seal gun 3 to an optional position at an optional speed.

The discharge controller 11 controls the discharge amount of the sealant when the sealant is discharged onto an object T from the seal gun 3.

Figure 2:
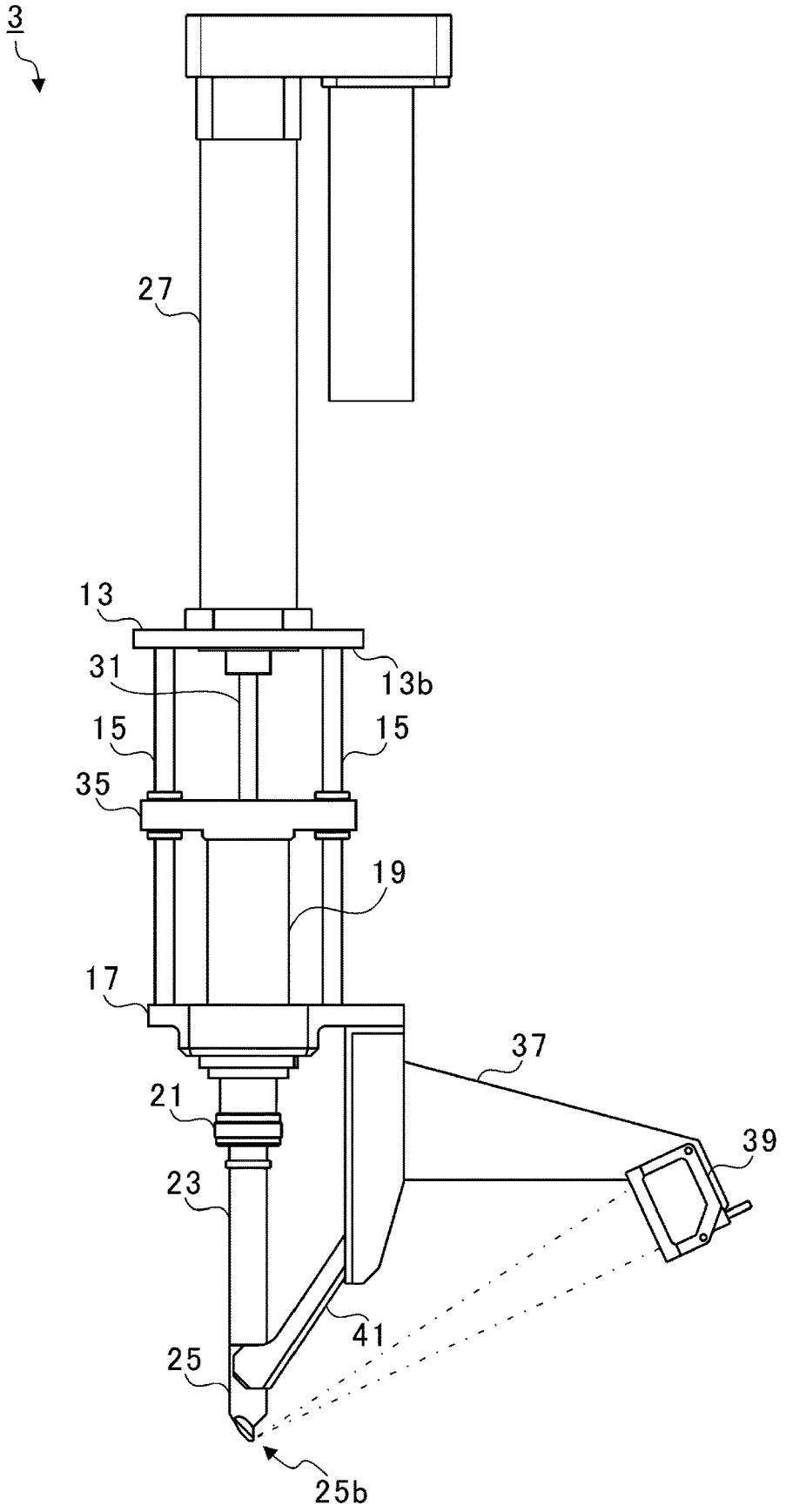
FIG. 2 is a diagram illustrating a configuration of a seal gun.
Figure 3:
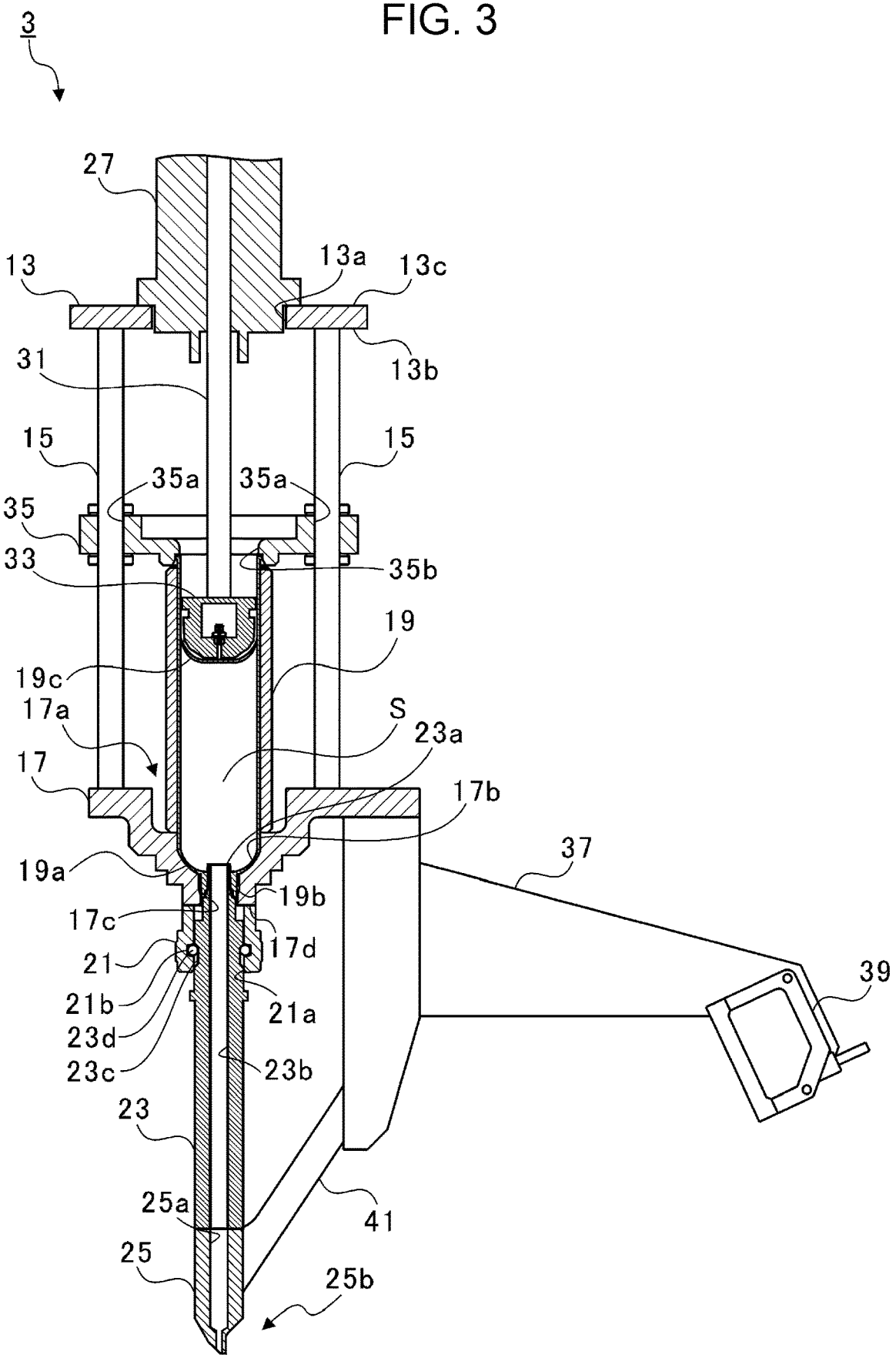
FIG. 3 is a partial cross-sectional view of the seal gun.

FIG. 2 is a diagram illustrating a configuration of the seal gun 3. FIG. 3 is a partial cross-sectional view of the seal gun 3. As illustrated in FIGS. 2 and 3, the seal gun 3 includes a support plate 13, rails 15, a cartridge receiver 17, a cartridge 19, a nozzle chuck 21, a nozzle adapter 23, a nozzle (the sealant discharging nozzle) 25, an actuator 27, a rod 31, a pusher 33, and a press plate 35. The seal gun 3 detachably holds the cartridge 19, the nozzle adapter 23, and the nozzle 25. Note that herein, a direction in which the pusher 33 moves is referred to as a sliding direction.

The support plate 13 is formed in a plate shape extending in a direction orthogonal to the sliding direction. A through hole 13*a* penetrating in the sliding direction is provided at the center of the support plate 13. The support plate 13 is supported by the leading end of the robot arm 5 (see FIG. 1). In other words, the seal gun 3 is attached to the robot arm 5 through the support plate 13.

Two rails 15 are attached to the undersurface 13*b* of the support plate 13. The two rails 15 extending in the sliding direction are provided at symmetrical positions in the support plate with the through hole 13*a* in between.

The cartridge receiver 17 is attached to the ends of the two rails 15 on the side opposite the support plate 13. A through hole 17*a* penetrating in the sliding direction is formed at the center of the cartridge receiver 17. The cartridge 19 is inserted into the through hole 17*a* from the support plate 13 side.

The cartridge 19 is formed in a cylindrical shape, and the tip 19*a* thereof is formed in a hemispherical shape. Furthermore, a protrusion 19*b* protruding so as to have a cylindrical shape is formed at the center of the tip 19*a*.

Sealant S is accommodated inside the cartridge 19. Furthermore, a plunger 19*c* movable in the sliding direction is provided in the cartridge 19. The cartridge 19 together with the plunger 19*c* seals the sealant S. The sealant S is a two liquid mixed sealant that becomes cured by mixing two different types of liquid.

A cartridge receiving groove 17*b* that is depressed in a hemispherical shape that matches the shape of the tip 19*a* of the cartridge 19 is formed in the through hole 17*a* of the cartridge receiver 17. Furthermore, a tapered portion 17*c* is formed at the center of the cartridge receiving groove 17*b*.

The nozzle chuck 21 is fixed to an undersurface 17*d* of the cartridge receiver 17. A through hole 21*a* penetrating in the sliding direction is formed in the nozzle chuck 21. An axial center of the through hole 21*a* is positioned coaxially with an axial center of the through hole 17*a* of the cartridge receiver 17. The nozzle adapter 23 is inserted in the through hole 21*a* of the nozzle chuck 21.

The nozzle adapter 23 is formed in a cylindrical shape. A first end 23*a* of the nozzle adapter 23 on the cartridge 19 side is inserted inside the protrusion 19*b* of the cartridge 19. Furthermore, a through hole 23*b* penetrating in the sliding direction is formed in the nozzle adapter 23. The through hole 23*b* is in communication with an internal space of the cartridge 19.

A plurality of ball grooves 21*b* are formed in an inner wall surface of the through hole 21*a* of the nozzle chuck 21. Furthermore, ball grooves 23*c* are formed in an outer peripheral surface of the nozzle adapter 23 at positions opposing the ball grooves 21*b* of the nozzle chuck 21. The ball grooves 23*c* are formed longer in the sliding direction than the ball grooves 21*b*. Balls 23*d* are disposed between the ball grooves 21*b* and the ball grooves 23*c*. The nozzle adapter 23 is supported by the nozzle chuck 21 through the balls 23*d* so as to be movable in the sliding direction.

An end of the nozzle adapter 23 on the side opposite the cartridge 19 is connected to the nozzle 25. A through hole 25*a* penetrating in the sliding direction is formed in the nozzle 25. The through hole 25*a* is, as a whole, formed in a cylindrical shape. The through hole 25*a* is in communication with the through hole 23*b* of the nozzle adapter 23. A shape of the nozzle 25 will be described later in detail.

The actuator 27 is attached to an upper surface 13*c* of the support plate 13. The leading end of the actuator 27 is inserted in the through hole 13*a* of the support plate 13. The rod 31 is accommodated inside the actuator 27 so as to be movable in the sliding direction. Based on the control of the discharge controller 11, the actuator 27 is driven to move the rod 31 in the sliding direction.

The pusher 33 is attached to a tip of the rod 31. The diameter of the pusher 33 formed in a hemispherical shape is smaller than the inner diameter of the cartridge 19. The pusher 33, associated with the movement of the rod 31, pushes the plunger 19*c* of the cartridge 19 in a discharge direction.

A space in communication with the leading end side (the plunger 19*c* side) is formed inside the pusher 33. The space formed inside the pusher 33 is connected to a vacuum pump (not shown). By driving the vacuum pump, the pusher 33 is capable of suctioning the plunger 19*c*.

The two rails 15 are inserted in the press plate 35. The press plate 35 is formed in a plate shape extending in a direction orthogonal to the sliding direction. Through holes 35*a* through which the rails 15 are inserted are formed in the press plate 35. The press plate 35 is movable along the rails 15. A through hole 35*b* is formed in the press plate 35 in the sliding direction. A diameter of the through hole 35*b* is larger than an outer diameter of the pusher 33 and is smaller than an outer diameter of the cartridge 19.

The press plate 35 is moved and controlled with an actuator (not shown). By moving in the sliding direction, the press plate 35 holds the cartridge 19 together with the cartridge receiver 17.

In the seal gun 3 configured in the above manner, when the pusher 33 is, based on the control of the discharge controller 11, moved towards the nozzle 25 side (the lower direction in the drawing), the sealant S accommodated inside the cartridge 19 is pushed by the plunger 19*c*. With the above, the sealant S passes through the through hole 23*b* and the through hole 25*a* with the pushing force of the pusher 33 and is discharged from a tip 25*b* of the nozzle 25 on the side opposite the nozzle adapter 23.

Furthermore, a measuring instrument support 37, a measuring instrument 39, and a nozzle support 41 are provided in the seal gun 3. The measuring instrument support 37 is attached to the nozzle 25 side of the cartridge receiver 17. The measuring instrument 39 is attached to a leading end of the measuring instrument support 37 on the side opposite the cartridge receiver 17.

The measuring instrument 39 is a ranging sensor. By emitting a laser beam and receiving the emitted laser beam, the measuring instrument 39 is capable of measuring a distance to a position where the laser beam had been reflected. The measuring instrument 39 irradiates the tip 25*b* of the nozzle 25 with the laser beam, in more detail, the measuring instrument 39 irradiates the sealant S that has been discharged from the nozzle 25 with the laser beam. By measuring the distance to the sealant S discharged from the nozzle 25, the seal gun 3 is capable of measuring the discharge amount of the sealant S.

A first end of the nozzle support 41 is attached to the measuring instrument support 37 and a second end thereof is engaged to the nozzle 25. With the above, the nozzle support 41 restrains the movement of the nozzle 25. A specific configuration of the nozzle 25 will be described below.

Figure 4:
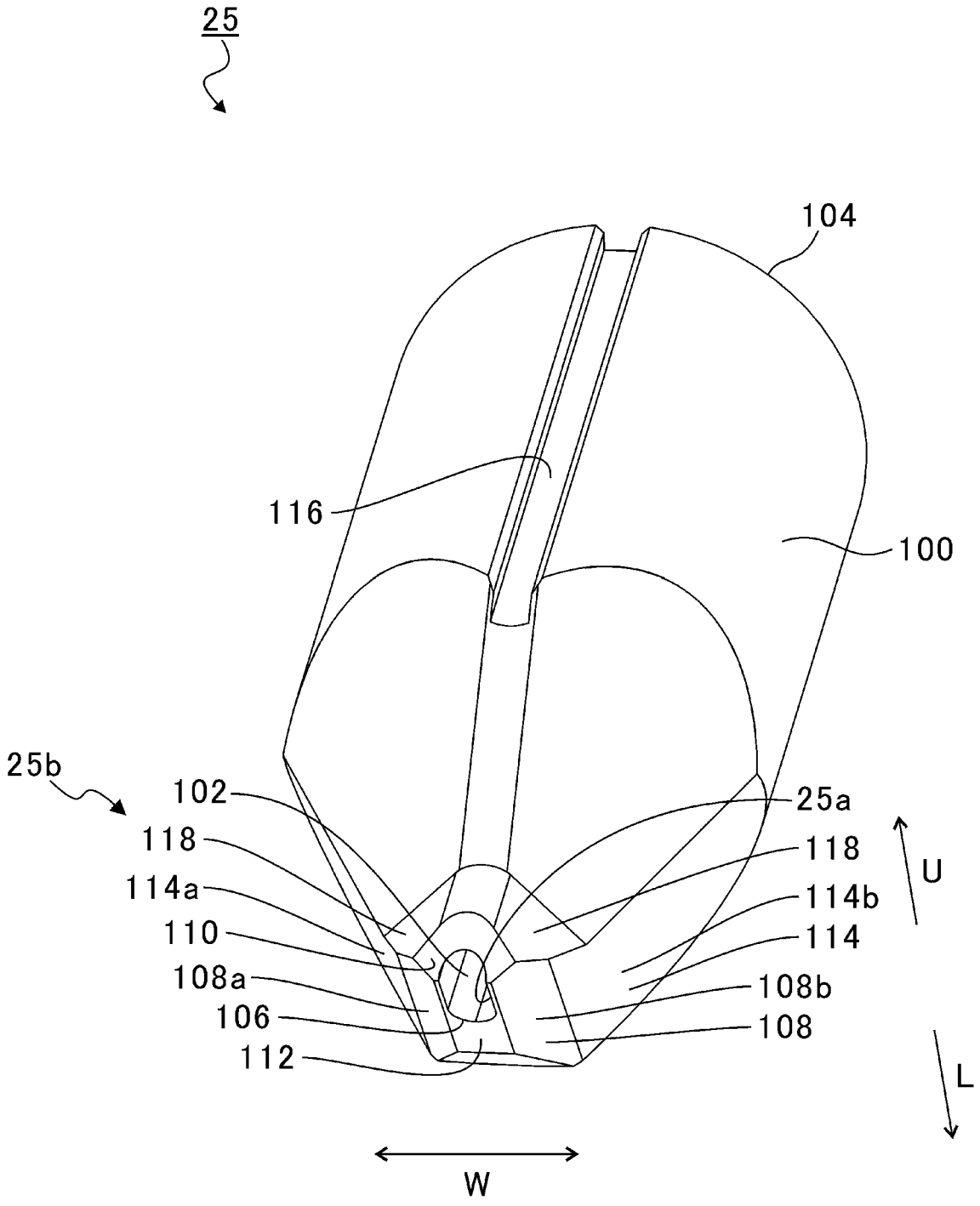
FIG. 4 is a diagram illustrating a configuration of a nozzle.

FIG. 4 is a diagram illustrating the configuration of the nozzle 25. As illustrated in FIG. 4, the nozzle 25 includes a nozzle body 100. The nozzle body 100 has a substantially cylindrical shape. Referring to FIG. 4, a two direction arrow W indicates a width direction of the nozzle body 100. An arrow U is orthogonal to the width direction W and indicates the upward direction (a height direction) of the nozzle body 100. An arrow L is orthogonal to the width direction W and indicates the downward direction (a height direction) of the nozzle body 100.

The through hole 25*a* is formed inside the nozzle body 100. The through hole 25*a* extends in a central axis direction (a longitudinal direction) of the nozzle body 100. The through hole 25*a* penetrates through the nozzle body 100. The through hole 25*a* forms an inner surface 102 of the nozzle body 100. An introduction port 104 is formed in a first end of the through hole 25*a*, and a discharge port 106 is formed in a second end thereof.

The introduction port 104 is coupled to the through hole 23*b* (see FIG. 3) of the nozzle adapter 23. The sealant S supplied from the cartridge 19 (see FIG. 3) through the nozzle adapter 23 is introduced to the introduction port 104. The sealant S introduced through the introduction port 104 flows through the through hole 25*a*. The discharge port 106 discharges the sealant S that has flowed through the through hole 25*a* to a portion external to the nozzle body 100. The discharge port 106 has a substantially elliptical shape.

The nozzle body 100 includes a nozzle positioning portion 108, a cutout groove (a cutout) 110, a shaping portion 112, an excessive seal leveling portion 114, an engaging groove (an engaging portion) 116, and a pair of tapered surfaces 118. The nozzle positioning portion 108, the cutout groove 110, the shaping portion 112, the excessive seal leveling portion 114, and the pair of tapered surfaces 118 are formed at the tip 25*b* (an end on the discharge port 106 side) of the nozzle body 100. The engaging groove 116 is formed in a lateral surface (an outer peripheral surface) of the nozzle body 100. The engaging groove 116 extends in the longitudinal direction of the nozzle body 100. Details of the nozzle positioning portion 108, the cutout groove 110, the shaping portion 112, the excessive seal leveling portion 114, and the engaging groove 116 will be described later.

Figure 5:
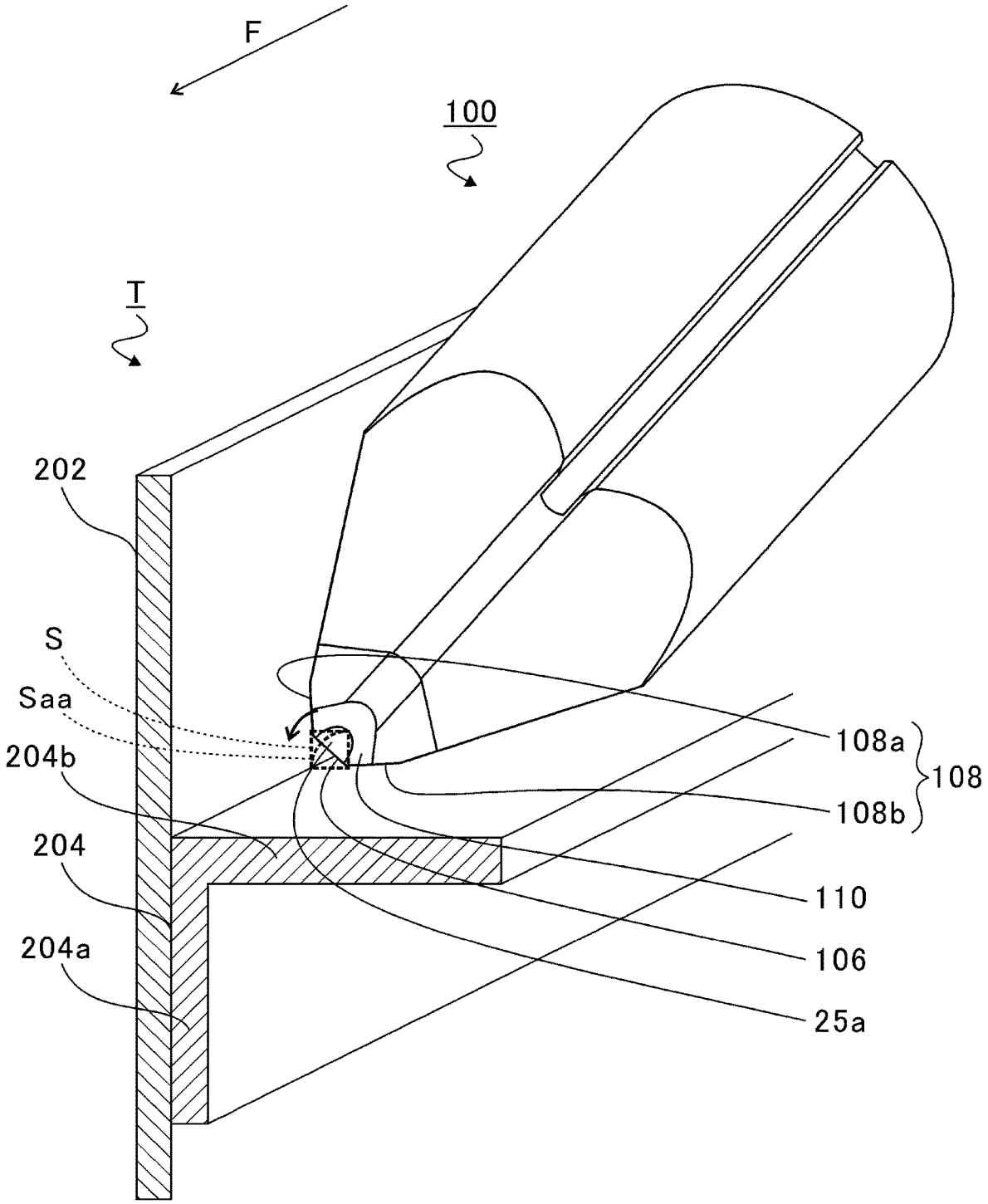
FIG. 5 is a diagram illustrating a state in which a nozzle body is applying sealant on an object.

FIG. 5 is a diagram illustrating a state in which the nozzle body 100 is applying the sealant S on the object T. Referring to FIG. 5, an arrow F indicates an advancing direction of the nozzle body 100. As illustrated in FIG. 5, the object T includes a first applied member 202 and a second applied member 204. The first applied member 202 has a substantially flat plate shape. The second applied member 204 has a substantially L-shape.

The second applied member 204 includes a parallel portion 204*a* and a perpendicular portion 204*b*. The parallel portion 204*a* is disposed substantially parallel to the first applied member 202 and is coupled (connected) to the first applied member 202. The perpendicular portion 204*b* is disposed substantially perpendicular to the first applied member 202 and is erected in a direction substantially perpendicular to the first applied member 202.

The nozzle body 100 applies the sealant S to a corner formed between the first applied member 202 and the second applied member 204. In so doing, the nozzle positioning portion 108 of the nozzle body 100 abuts against the first applied member 202 and the second applied member 204. The nozzle positioning portion 108 has a substantially planar shape. The nozzle positioning portion 108 positions the nozzle body 100 with respect to the first applied member 202 and the second applied member 204 by abutting against the first applied member 202 and the second applied member 204.

The nozzle positioning portion 108 includes a first abutting surface 108*a* and a second abutting surface 108*b*. The first abutting surface 108*a* abuts against a surface of the first applied member 202. The second abutting surface 108*b* abuts against a surface of the perpendicular portion 204*b* of the second applied member 204. The first abutting surface 108*a* is a surface substantially orthogonal to the second abutting surface 108*b*. The position of the nozzle body 100 against the object T is set by abutting the first abutting surface 108*a* against the surface of the first applied member 202 and abutting the second abutting surface 108*b* against the surface of the perpendicular portion 204*b* of the second applied member 204.

In so doing, the nozzle body 100 is, with respect to the object T, inclined at substantially 45 degrees rearwardly in an advancing direction F. Specifically, the nozzle body 100 is, with respect to the first applied member 202, inclined at substantially 45 degrees rearwardly in the advancing direction F. Furthermore, the nozzle body 100 is, with respect to the perpendicular portion 204*b* of the second applied member 204, inclined at substantially 45 degrees rearwardly in the advancing direction F. In the present embodiment, while being inclined substantially 45 degrees towards the side opposite the advancing direction F (rearwardly in the advancing direction F), the nozzle body 100 is held by the seal gun 3 (see FIG. 1).

Note that if the nozzle body 100 were to be displaced perpendicular to the first applied member 202 and the perpendicular portion 204*b* of the second applied member 204, when the sealant S is applied to the object T, force that tilts the nozzle body 100 forwardly in the advancing direction F or rearwardly in the advancing direction F will act on the nozzle body 100. As a result, it will be difficult for the nozzle body 100 to apply the sealant S to the object T in a stable manner.

Accordingly, the nozzle positioning portion 108 positions the nozzle body 100 so that the nozzle body 100 is disposed and inclined, with respect to the object T, at substantially 45 degrees rearwardly in the advancing direction F. Specifically, when the nozzle body 100 is inclined at substantially 45 degrees rearwardly in the advancing direction F, the first abutting surface 108*a* abuts against the surface of the first applied member 202. Furthermore, when the nozzle body 100 is inclined at substantially 45 degrees rearwardly in the advancing direction F, the second abutting surface 108*b* abuts against the surface of the perpendicular portion 204*b* of the second applied member 204. With the above, the nozzle body 100 is capable of applying the sealant S to the object T in a stable manner.

The nozzle body 100 is moved in the advancing direction F with the robot arm 5 (see FIG. 1) while the nozzle positioning portion 108 is abutted against the first applied member 202 and the second applied member 204. The nozzle body 100 discharges the sealant S from the discharge port 106 while moving in the advancing direction F.

Figure 6:
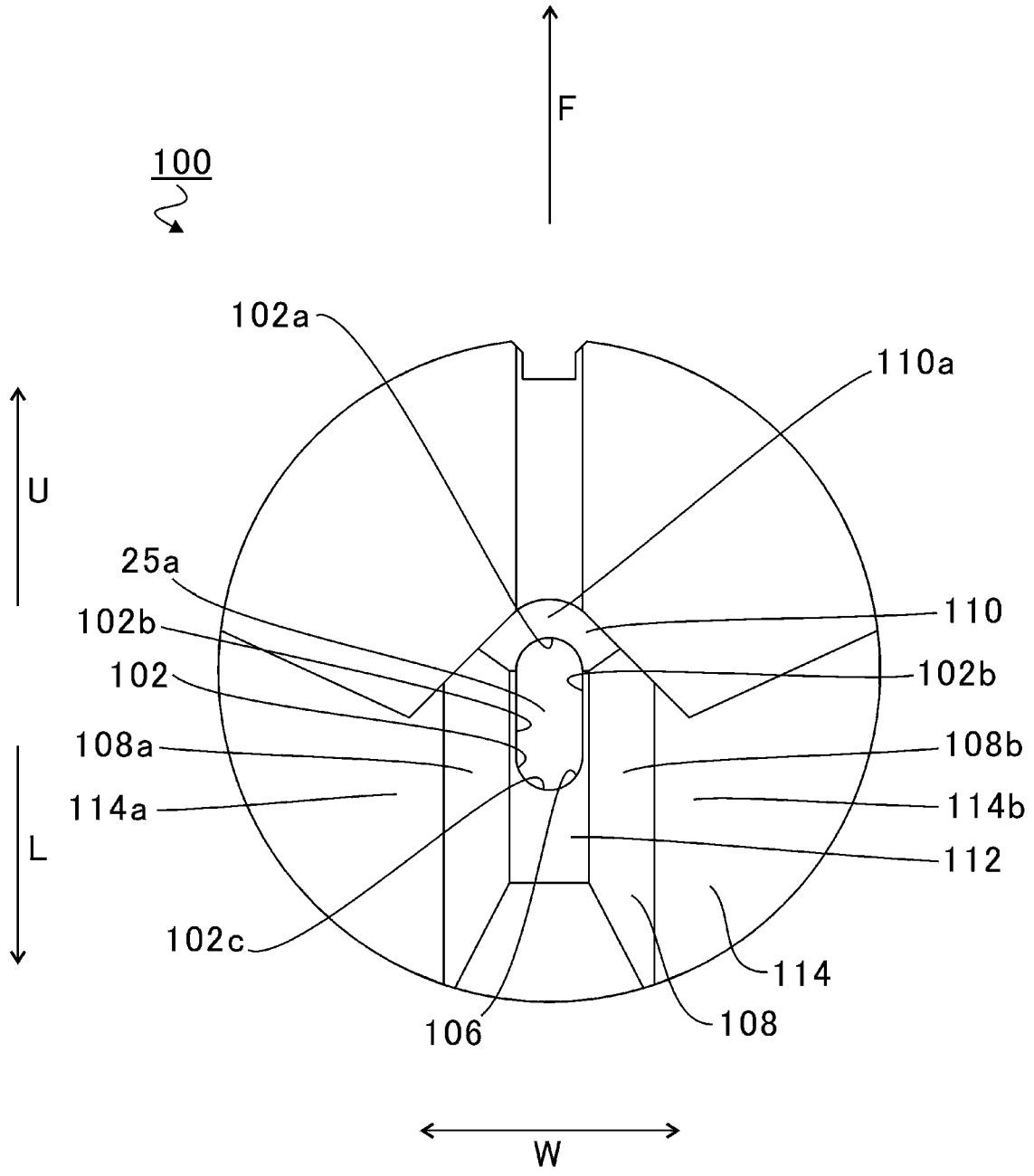
FIG. 6 is a diagram of the nozzle body viewed from a discharge port side.

FIG. 6 is a diagram of the nozzle body 100 viewed from the discharge port 106 side. As illustrated in FIG. 6, the discharge port 106 of the through hole 25*a* is formed in a substantially elliptical shape that extends in the advancing direction F of the nozzle body 100. The inner surface 102 of the through hole 25*a* includes an upper surface 102*a*, a pair of lateral surfaces 102*b*, and an undersurface 102*c*. The upper surface 102*a* and the undersurface 102*c* are formed on the discharge port 106 side of the through hole 25*a*, and each have a substantially arc shape that extends along the central axis (the longitudinal direction) of the nozzle body 100. The pair of lateral surfaces 102*b* are formed on the discharge port 106 side of the through hole 25*a*, and each have a substantially planar shape that extends along the central axis (the longitudinal direction) of the nozzle body 100. The upper surface 102*a* is formed on an upward direction U side of the through hole 25*a*. The pair of lateral surfaces 102*b* are each formed on the width direction W side of the through hole 25*a*. The undersurface 102*c* is formed on a downward direction L side of the through hole 25*a*. As illustrated in FIG. 6, in the discharge port 106 that is an opening of the through hole 25*a* and that is provided in an end surface of the nozzle body 100, the width in the width direction W is smaller than the width in the upward direction U (the advancing direction F) or in the downward direction L. In other words, in the discharge port 106 of the through hole 25*a*, compared with a width in a first direction (the upward direction U or the downward direction L) orthogonal to the central axis of the nozzle body 100, a width in a second direction (the width direction W) orthogonal to the first direction is small.

As it can be understood by referring to FIGS. 4 and 6, the cutout groove 110 of the nozzle body 100 is, with respect to the undersurface 102*c* of the through hole 25*a* (the discharge port 106), formed on the forward side (the upward direction U side in FIG. 6) in the advancing direction F of the nozzle body 100. The cutout groove 110 has a substantially U-shape. In the cutout groove 110, the outside portions are located on the leading end side with respect to the center portion in the width direction W. The cutout groove 110 is adjacent to the inner surface 102 of the through hole 25*a* (the discharge port 106) and is in communication with the through hole 25*a*. The cutout groove 110 exposes a portion of the through hole 25*a* to the outside.

The cutout groove 110 includes an inclined surface 110*a* having a substantially U-shape. The inclined surface 110*a* is inclined from the discharge port 106 side towards the introduction port 104 side with respect to a plane orthogonal to the longitudinal direction of the nozzle body 100. When the position of the nozzle body 100 with respect to the object T is set, the inclined surface 110*a* forms a plane that is substantially perpendicular to the surfaces of the first applied member 202 and the perpendicular portion 204*b* of the second applied member 204. Furthermore, regarding the shape of the cutout groove 110, as the cutout groove 110 becomes closer to the center (the central axis) in the width direction W, the separated distance from the discharge port 106 becomes larger.

Returning to FIG. 5, the sealant S flowing through the through hole 25*a* is discharged from the discharge port 106. Furthermore, the sealant S flows into the cutout groove 110 from the through hole 25*a*. The sealant S that has flowed into the cutout groove 110 becomes accumulated along the shape of the cutout groove 110 (in other words, in a substantially U-shape).

In the above, when the nozzle body 100 moves in the advancing direction F, the sealant S that has been discharged from the discharge port 106 and that has been applied to the object T relatively moves rearwardly in the advancing direction F of the nozzle body 100, which is opposite the forward side in the advancing direction F. The sealant S that has been accumulated in a substantially U-shape moves with the flow of the sealant S relatively moving rearwardly in the advancing direction F and, as illustrated by a bent arrow in FIG. 5, is rotationally moved in an arc shape. By having the sealant S that has been accumulated in a substantially U-shape be moved in a rotational manner, as illustrated in FIG. 5, a substantially bicone shape (a substantially rhombus shape) is formed by the sealant S. The corner between the first applied member 202 and the second applied member 204 is filled by the sealant S formed in a substantially bicone shape.

Returning back to FIG. 6 once again, the nozzle positioning portion 108 is formed on both sides (on the outside) of the undersurface 102*c* of the through hole 25*a* (the discharge port 106) in the width direction W. Specifically, the first abutting surface 108*a* and the second abutting surface 108*b* are formed on both sides of the undersurface 102*c* of the through hole 25*a* (the discharge port 106) in the width direction W. The first abutting surface 108*a* and the second abutting surface 108*b* are a pair of tapered surfaces that are inclined against the central axis of the nozzle body 100 so that the gap between the two in the central axis direction of the nozzle body 100 becomes larger as the two are separated from the discharge port 106.

The shaping portion 112 of the nozzle body 100 is formed between the first abutting surface 108*a* and the second abutting surface 108*b*. The shaping portion 112 has a substantially planar shape. The shaping portion 112 is adjacent to the inner surface 102 of the through hole 25*a* (the discharge port 106). The shaping portion 112 is formed on the rearward side (on the downward direction L side in FIG. 6) in the advancing direction F of the nozzle body 100 with respect to the undersurface 102*c* of the through hole 25*a* (the discharge port 106). In other words, the cutout groove 110 of the nozzle body 100 is formed on a first side with respect to the undersurface 102*c* of the through hole 25*a*, and the shaping portion 112 is formed on a second side, which is a side opposite the first side, with respect to the undersurface 102*c* of the through hole 25*a*. In the width direction W, a width of the shaping portion 112 is substantially the same as a width of the discharge port 106. The shaping portion 112 shapes the sealant S discharged from the discharge port 106.

The excessive seal leveling portion 114 of the nozzle body 100 is formed on both sides (outside) of the nozzle positioning portion 108 in the width direction W of the nozzle body 100. The excessive seal leveling portion 114 each have a substantially planar shape. Note that the details of the excessive seal leveling portion 114 will be described later.

Figure 7:
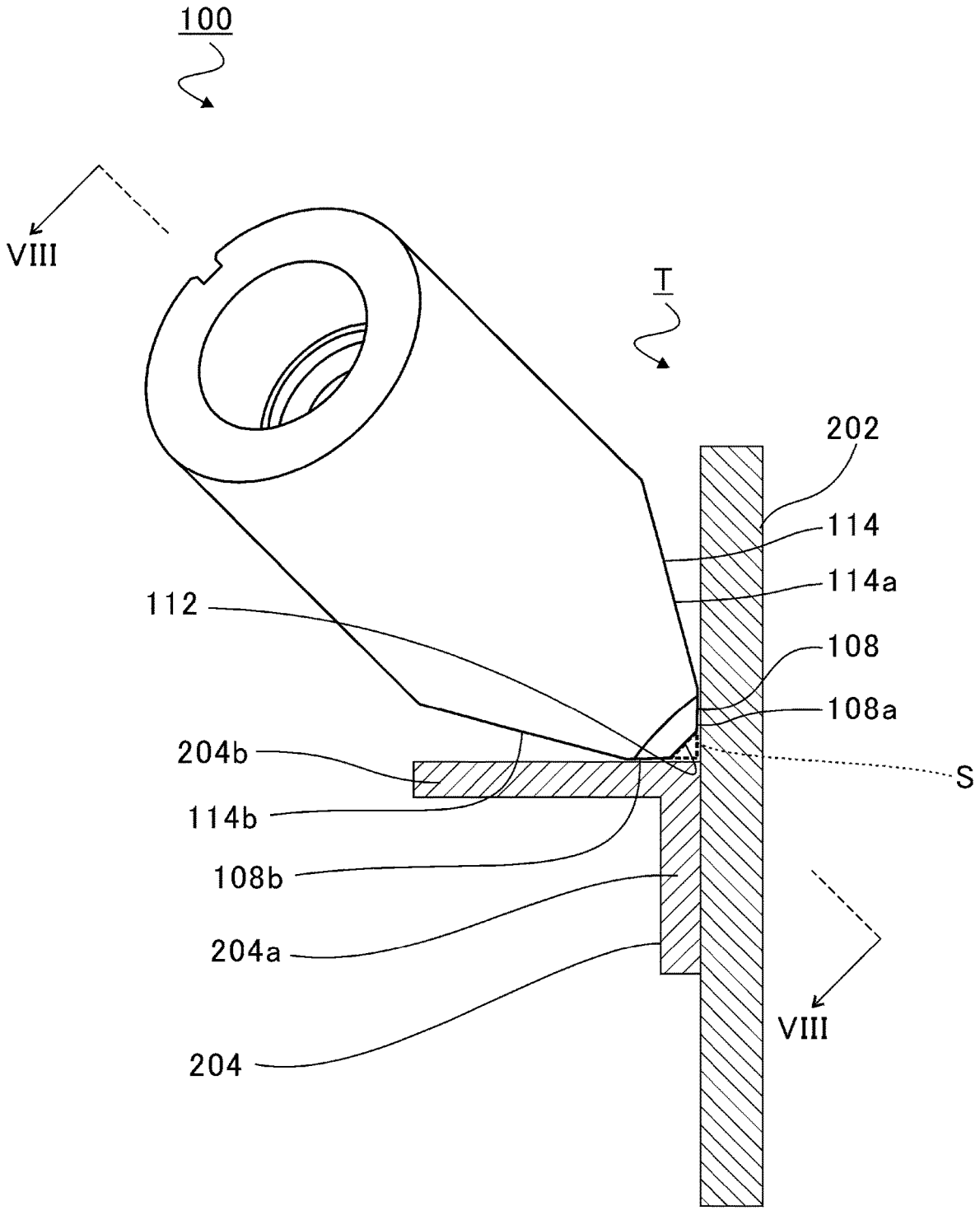
FIG. 7 is a diagram of the nozzle body illustrated in FIG. 5 viewed from a rear side in an advancing direction.

FIG. 7 is a diagram of the nozzle body 100 illustrated in FIG. 5 viewed from the rear side in the advancing direction F. As illustrated in FIG. 7, the nozzle body 100 forms a target sealing cross-sectional shape (a substantially triangular shape in the present embodiment) with the shaping portion 112, the first applied member 202, and the second applied member 204.

Figure 8:
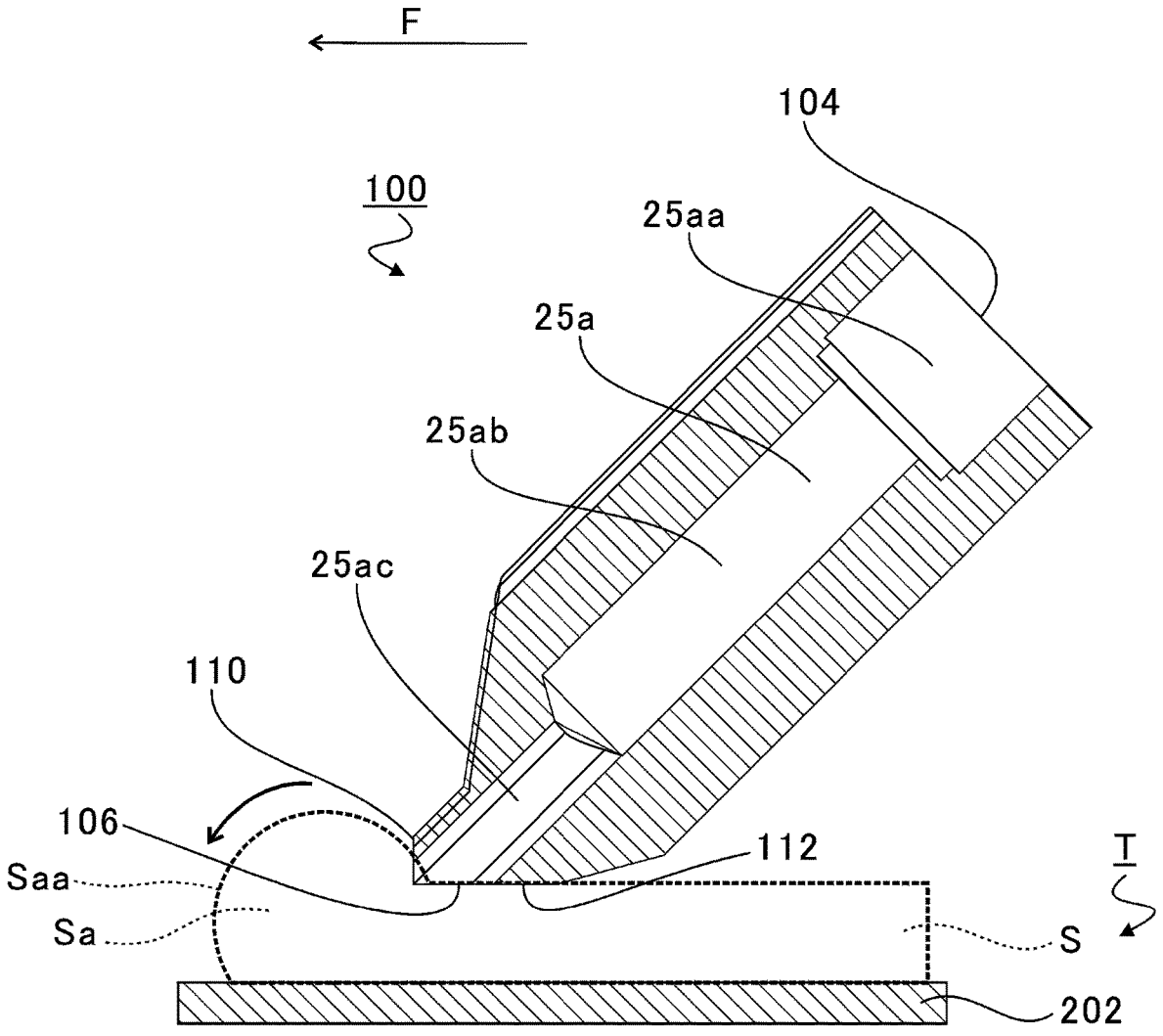
FIG. 8 is a cross-sectional view taken along line VIII-VIII in FIG. 7.

FIG. 8 is a cross-sectional view taken along line VIII-VIII in FIG. 7. As illustrated in FIG. 8, the through hole 25*a* is formed inside the nozzle body 100. The through hole 25*a* includes a first circular passage 25*aa*, a second circular passage 25*ab*, and an elliptical passage 25*ac*. A passage cross-sectional shape of the first circular passage 25*aa* is substantially circular. The first circular passage 25*aa* extends in the longitudinal direction of the nozzle body 100. A first end of the first circular passage 25*aa* is connected with the introduction port 104 of the nozzle body 100, and a second end is connected with the second circular passage 25*ab*.

A passage cross-sectional shape of the second circular passage 25*ab* is substantially circular. The second circular passage 25*ab* extends in the longitudinal direction of the nozzle body 100. A first end of the second circular passage 25*ab* is connected with the first circular passage 25*aa*, and a second end is connected with the elliptical passage 25*ac*. An inner diameter of the second circular passage 25*ab* is smaller than an inner diameter of the first circular passage 25*aa*. Since the passage cross-sectional shapes of the first circular passage 25*aa* and the second circular passage 25*ab* are substantially circular, the pipeline resistance when the sealant S flows therethrough can be small.

A passage cross-sectional shape of the elliptical passage 25*ac* is substantially elliptic. The elliptical passage 25*ac* extends in the longitudinal direction of the nozzle body 100. A first end of the elliptical passage 25*ac* is connected with the second circular passage 25*ab*, and a second end is connected with the discharge port 106 of the nozzle body 100.

In the present embodiment, the nozzle body 100 applies a narrow-bead sealant S to the object T. If the discharge port 106 of the nozzle body 100 has a circular shape with a small diameter, the pipeline resistance of the circular passage forming the circular discharge port with a small diameter becomes large and it will be difficult to control the discharge amount of the sealant S. Accordingly, workability in applying the sealant S becomes poor.

Accordingly, in the nozzle body 100 of the present embodiment, the elliptical passage 25*ac* is formed so that the discharge port 106 has a substantially elliptical shape. Compared with a circular passage in which the widths in the short direction are the same, the elliptical passage 25*ac* can increase the passage cross-sectional area. With the above, the pipeline resistance when the sealant S flows through the elliptical passage 25*ac* can be made smaller than the pipeline resistance of a circular passage in which the widths in the short direction are the same.

Furthermore, an end of the elliptical passage 25*ac* on the discharge port 106 side is, with the cutout groove 110, exposed to an external portion on the forward side in the advancing direction F of the nozzle body 100. A portion of the sealant S flowing in the elliptical passage 25*ac* is discharged from the discharge port 106, and the other portion flows into the cutout groove 110. By moving towards the forward side in the advancing direction F of the nozzle body 100 and due to the shape of the cutout groove 110, the sealant S that has flowed into the cutout groove 110 is formed into a substantially bicone shape (a substantially rhombus shape). With the above, on the forward side in the advancing direction F of the nozzle body 100, a bicone shaped portion Sa is formed on the object T with the sealant S. As illustrated in FIG. 5, a protrusion Saa, in which the interior angle is substantially a right angle, is formed on the outer peripheral surface of the bicone shaped portion Sa. The interior angle of the protrusion Saa is substantially the same as the angle of the corner between the first applied member 202 and the second applied member 204.

When the nozzle body 100 moves forwardly in the advancing direction F, the bicone shaped portion Sa rotates and moves in the bent arrow direction in FIG. 8, and the protrusion Saa becomes adhered to the corner between the first applied member 202 and the second applied member 204. In other words, when the nozzle body 100 moves forwardly in the advancing direction F, the bicone shaped portion Sa seals the corner between the first applied member 202 and the second applied member 204 (see FIG. 7).

Note that when the sealant S having a circular cross-sectional shape or a rectangular cross-sectional shape is formed (in other words, when the bicone shaped portion Sa is not formed) on the object T, it will be difficult for the sealant S to adhere to the corner between the first applied member 202 and the second applied member 204. In other words, it will be difficult for the sealant S to seal the corner between the first applied member 202 and the second applied member 204 if the bicone shaped portion Sa is not formed. As a result, air (bubbles) tend to become mixed into the sealant S applied on the object T.

On the other hand, when the bicone shaped portion Sa is formed on the object T, it will be easier for the sealant S to adhere to the corner between the first applied member 202 and the second applied member 204. In other words, it will be easy for the sealant S to seal the corner between the first applied member 202 and the second applied member 204 when the bicone shaped portion Sa is formed. As a result, air (bubbles) tend not to become mixed into the sealant S applied on the object T.

The sealant S that has sealed the corner between the first applied member 202 and the second applied member 204 relatively moves rearwardly in the advancing direction F of the nozzle body 100 as the nozzle body 100 moves in the advancing direction F. The shaping portion 112 is disposed on the rearward side in the advancing direction F of the discharge port 106. The shaping portion 112 is disposed so as to be inclined at substantially 45 degrees against the longitudinal direction of the nozzle body 100.

Returning back to FIG. 7, the sealant S that has relatively moved rearwardly in the advancing direction F from the discharge port 106 is pushed towards the first applied member 202 side and the second applied member 204 side with the shaping portion 112. A substantially triangular space is formed between the shaping portion 112, the first applied member 202, and the second applied member 204.

The shaping portion 112 squashes the sealant S to accommodate the sealant S into the space enclosed by the shaping portion 112, the first applied member 202, and the second applied member 204. With the above, the shaping portion 112 shapes the sealant S into a band shape having a substantially triangular cross-sectional shape.

In so doing, a portion of the sealant S, which is squashed by the shaping portion 112, may protrude to the outer diameter sides of the first abutting surface 108*a* and the second abutting surface 108*b*. Accordingly, the nozzle body 100 includes the excessive seal leveling portion 114 on the outer diameter side with respect to the shaping portion 112. The excessive seal leveling portion 114 includes a first leveling surface 114*a* and a second leveling surface 114*b*. The first leveling surface 114*a* and the second leveling surface 114*b* are a pair of tapered surfaces that are inclined against the central axis of the nozzle body 100 so that the distance between the two in the central axis direction of the nozzle body 100 becomes larger as the two are separated from the discharge port 106. The angles of the first leveling surface 114*a* and the second leveling surface 114*b* inclined against the central axis of the nozzle body 100 are smaller than the angles of the first abutting surface 108*a* and the second abutting surface 108*b* against the central axis of the nozzle body 100.

The first leveling surface 114*a* is disposed on the outer diameter side with respect to the first abutting surface 108*a* and is adjacent to the first abutting surface 108*a*. The first leveling surface 114*a* is not in contact with the first applied member 202. In other words, the first leveling surface 114*a* is disposed so as to be separated from the first applied member 202. The angle between the first leveling surface 114*a* and the first applied member 202 is, for example, about 5 degrees when the first abutting surface 108*a* and the first applied member 202 abut against each other. The first leveling surface 114*a* pushes the sealant S, which has been protruded to the outer diameter side with the first abutting surface 108*a*, against the first applied member 202 so that the sealant S is adhered to the first applied member 202 in a smooth manner.

The second leveling surface 114*b* is disposed on the outer diameter side with respect to the second abutting surface 108*b* and is adjacent to the second abutting surface 108*b*. The second leveling surface 114*b* is not in contact with the second applied member 204. In other words, the second leveling surface 114*b* is disposed so as to be separated from the second applied member 204. The angle between the second leveling surface 114*b* and the second applied member 204 is, for example, about 5 degrees when the second abutting surface 108*b* and the second applied member 204 abut against each other. The second leveling surface 114*b* pushes the sealant S, which has been protruded to the outer diameter side with the second abutting surface 108*b*, against the second applied member 204 so that the sealant S is adhered to the second applied member 204 in a smooth manner.

Figure 9:
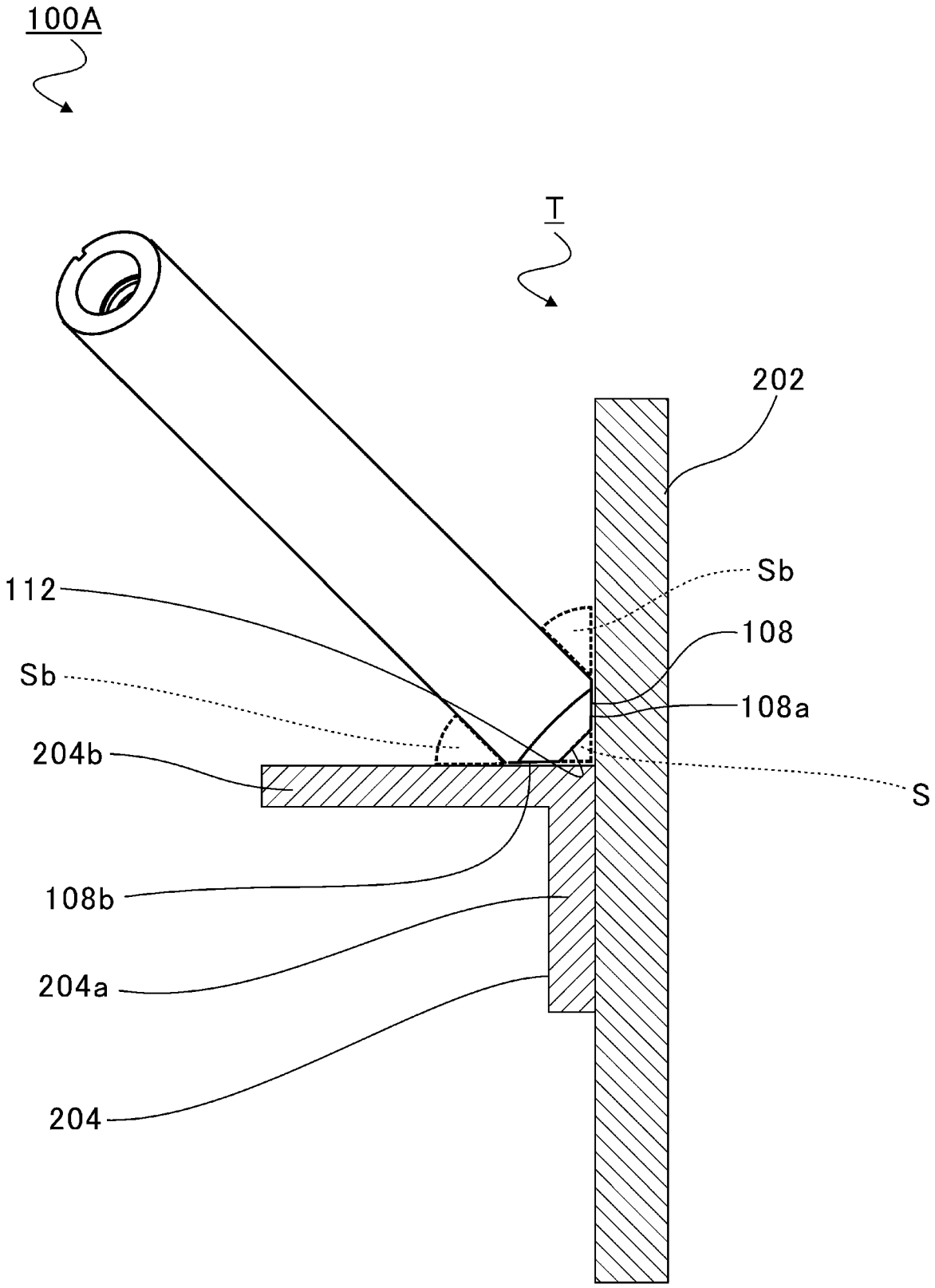
FIG. 9 is a diagram illustrating a state in which a nozzle body, serving as a comparative example, is applying sealant to an object.

FIG. 9 is a diagram illustrating a state in which a nozzle body 100A, serving as a comparative example, is applying the sealant S to the object T. As illustrated in FIG. 9, the excessive seal leveling portion 114 illustrated in FIG. 7 is not formed in the nozzle body 100A serving as the comparative example. In FIG. 9, components that are practically the same as those of the nozzle body 100 of the present embodiment are denoted with the same reference and descriptions thereof are omitted.

As illustrated in FIG. 9, when portions of the sealant S protrude to the outer diameter sides with respect to the first abutting surface 108*a* and the second abutting surface 108*b*, excessive seals Sb are formed on the outer diameter sides of the first abutting surface 108*a* and the second abutting surface 108*b*.

Figure 10:
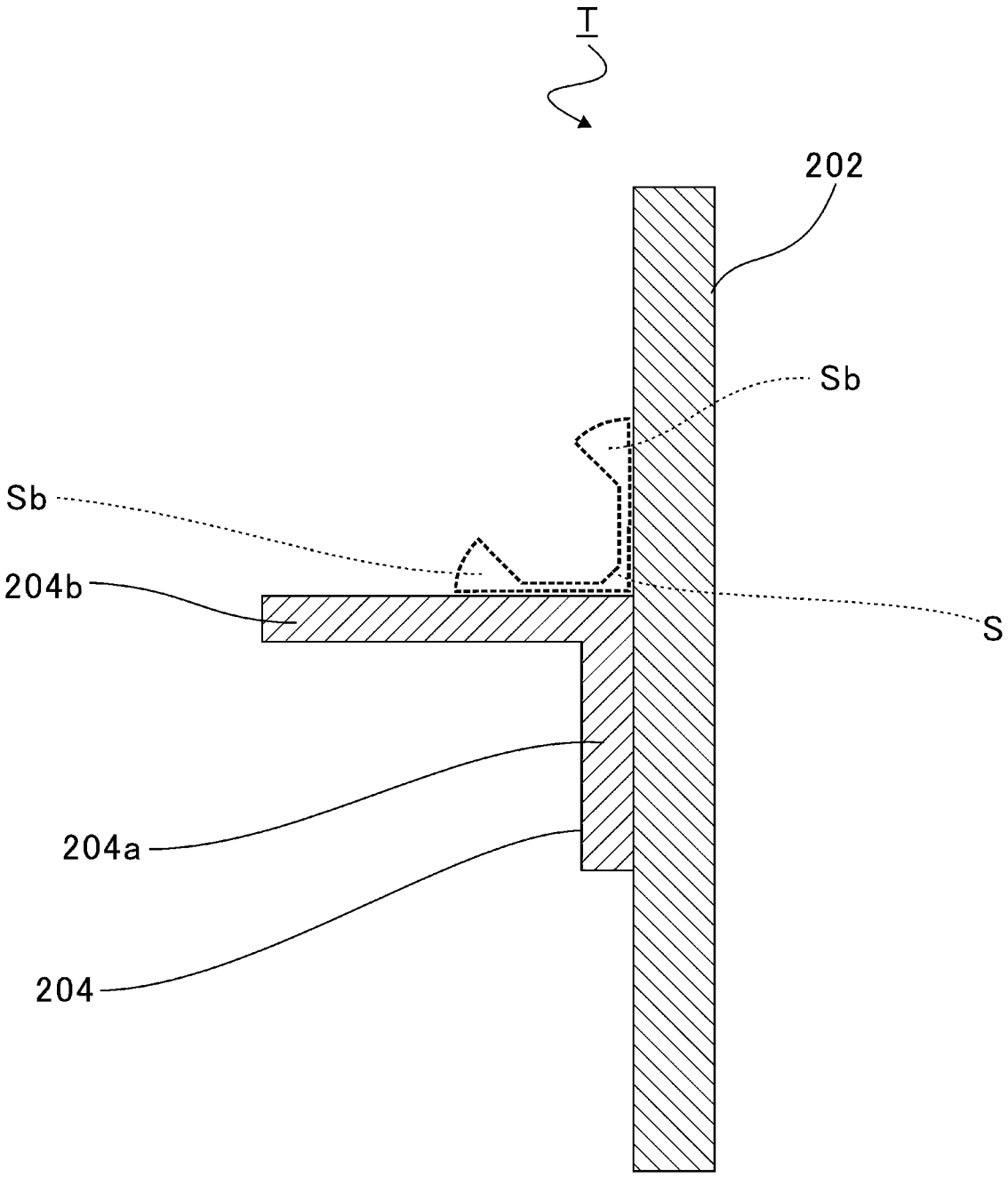
FIG. 10 is a diagram illustrating the sealant formed on the object with the nozzle body serving as the comparative example.

FIG. 10 is a diagram illustrating the sealant S formed on the object T with the nozzle body 100A serving as the comparative example. As illustrated in FIG. 10, the excessive seals Sb form protrusions that protrude in directions extending away from the surfaces of the first applied member 202 and the second applied member 204. Accordingly, the sealant S formed by the nozzle body 100A serving as the comparative example may become peeled due to the excessive seals Sb (the protrusions) that protrude in directions extending away from the first applied member 202 and the second applied member 204.

Figure 11:
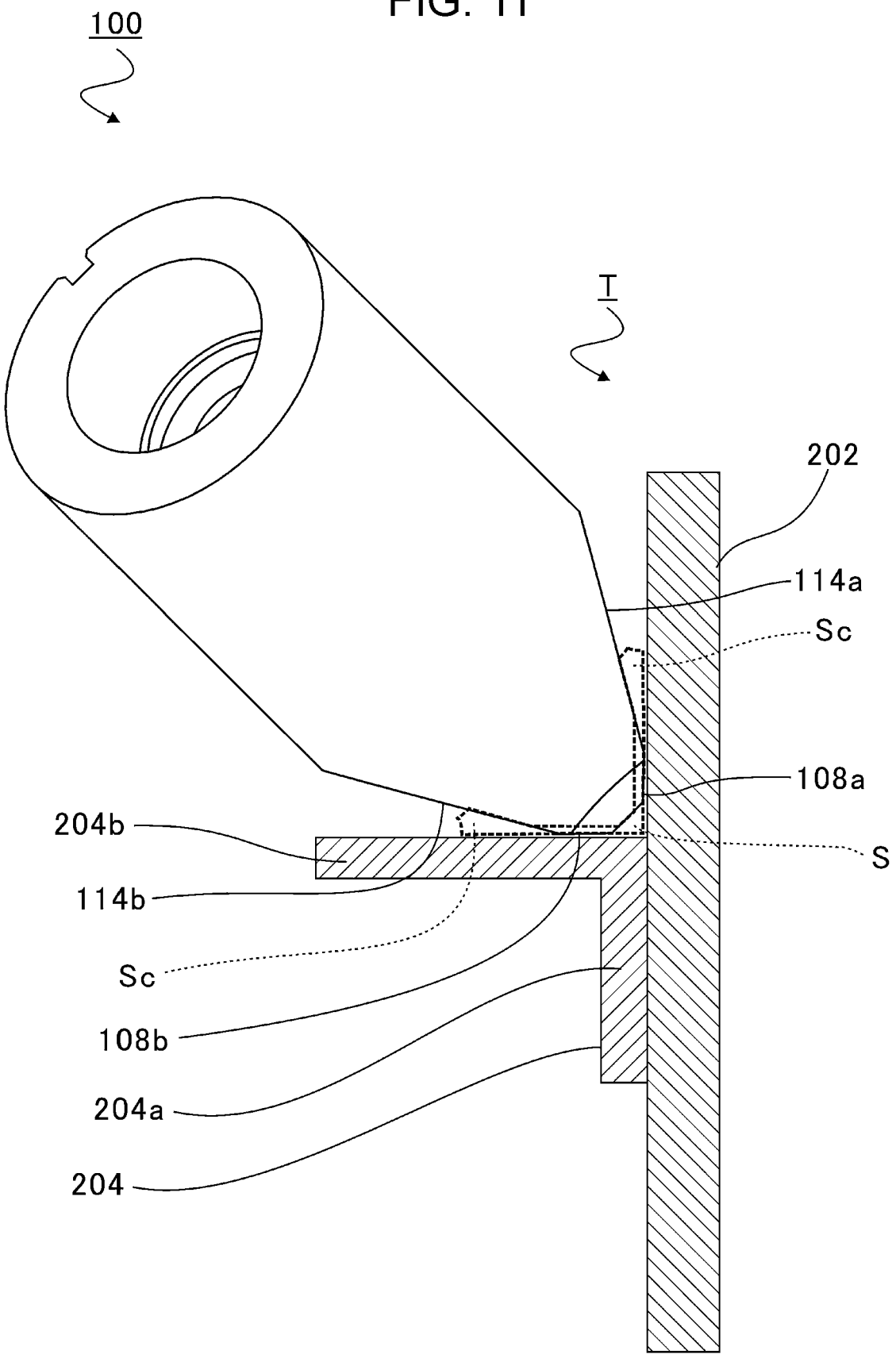
FIG. 11 is a diagram illustrating the sealant formed on the object with the nozzle body of the embodiment.

FIG. 11 is a diagram illustrating the sealant S formed on the object T with the nozzle body 100 of the present embodiment. As illustrated in FIG. 11, the sealant S that has protruded to the outer diameter sides with the first abutting surface 108*a* and the second abutting surface 108*b* is squashed by the first leveling surface 114*a* and the second leveling surface 114*b* and, accordingly, excessive seals Sc are formed.

The excessive seals Sc form protrusions that protrude in directions extending away from the surfaces of the first applied member 202 and the second applied member 204. However, the excessive seals Sc are squashed towards the first applied member 202 side and the second applied member 204 side with the first leveling surface 114*a* and the second leveling surface 114*b*. Accordingly, compared with the excessive seals Sb in the comparative example illustrated in FIG. 10, the heights of the excessive seals Sc in the directions extending away from the first applied member 202 and the second applied member 204 are lower. Accordingly, peeling from the first applied member 202 and the second applied member 204 due to the excessive seals Sc can be reduced in the sealant S applied by the nozzle body 100 of the present embodiment.

Note that as illustrated in FIG. 4, the pair of tapered surfaces 118 are formed in the nozzle body 100. The pair of tapered surfaces 118 are disposed on the introduction port 104 side with respect to the cutout groove 110. In the pair of tapered surfaces 118, the ends on the discharge port 106 side are connected with the cutout groove 110, and the ends on both sides in the width direction W are connected with the excessive seal leveling portion 114. The gap between the pair of tapered surfaces 118 in the width direction W of the nozzle body 100 becomes larger from the discharge port 106 side towards the introduction port 104 side.

When the nozzle body 100 moves forwardly in the advancing direction F, a portion of the sealant S is introduced to the pair of tapered surfaces 118 from the cutout groove 110. The pair of tapered surfaces 118 guide the sealant S introduced from the cutout groove 110 to the excessive seal leveling portion 114. Note that if the pair of tapered surfaces 118 are not formed, the sealant S will tend to accumulate at the tip 25*b* of the nozzle body 100. If the sealant S accumulates at the tip 25*b* of the nozzle body 100, a process of removing the accumulated sealant S will be needed after the sealant S had been applied on the object T. By having the nozzle body 100 include the pair of tapered surfaces 118, the process of removing the sealant S that has accumulated at the tip 25*b* of the nozzle body 100 can be reduced.

Figure 12:
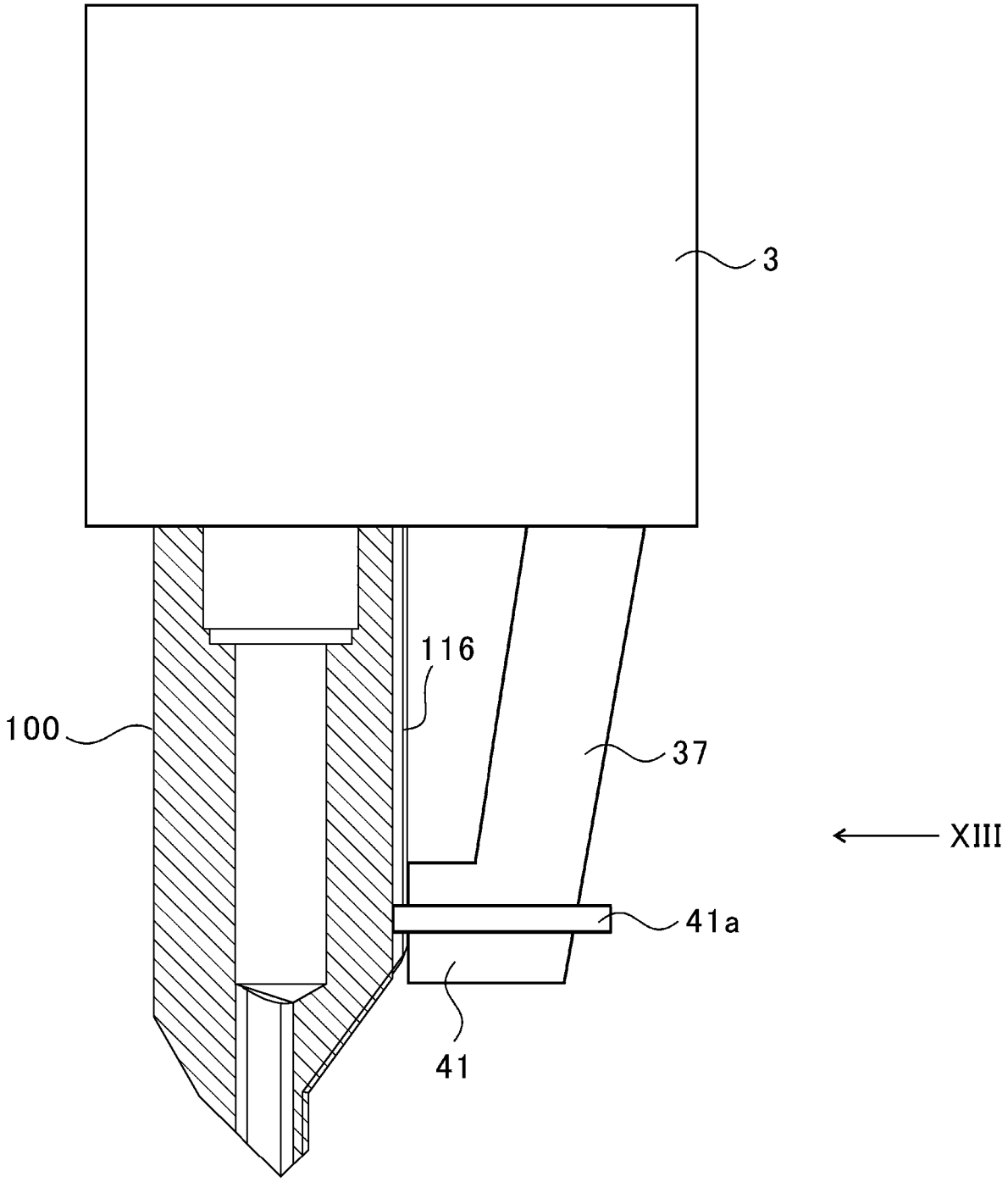
FIG. 12 is a diagram illustrating a state in which the nozzle body is attached to the seal gun.

FIG. 12 is a diagram illustrating a state in which the nozzle body 100 is attached to the seal gun 3. As illustrated in FIG. 12, the seal gun 3 includes the measuring instrument support 37 and the nozzle support 41. The nozzle support 41 further includes a locating pin (an engaging pin) 41*a*. The locating pin 41*a* has a substantially columnar shape and is capable of engaging with the engaging groove 116 of the nozzle body 100. The locating pin 41*a* is engaged with the engaging groove 116 of the nozzle body 100 when the nozzle body 100 is attached to the seal gun 3.

Figure 13:
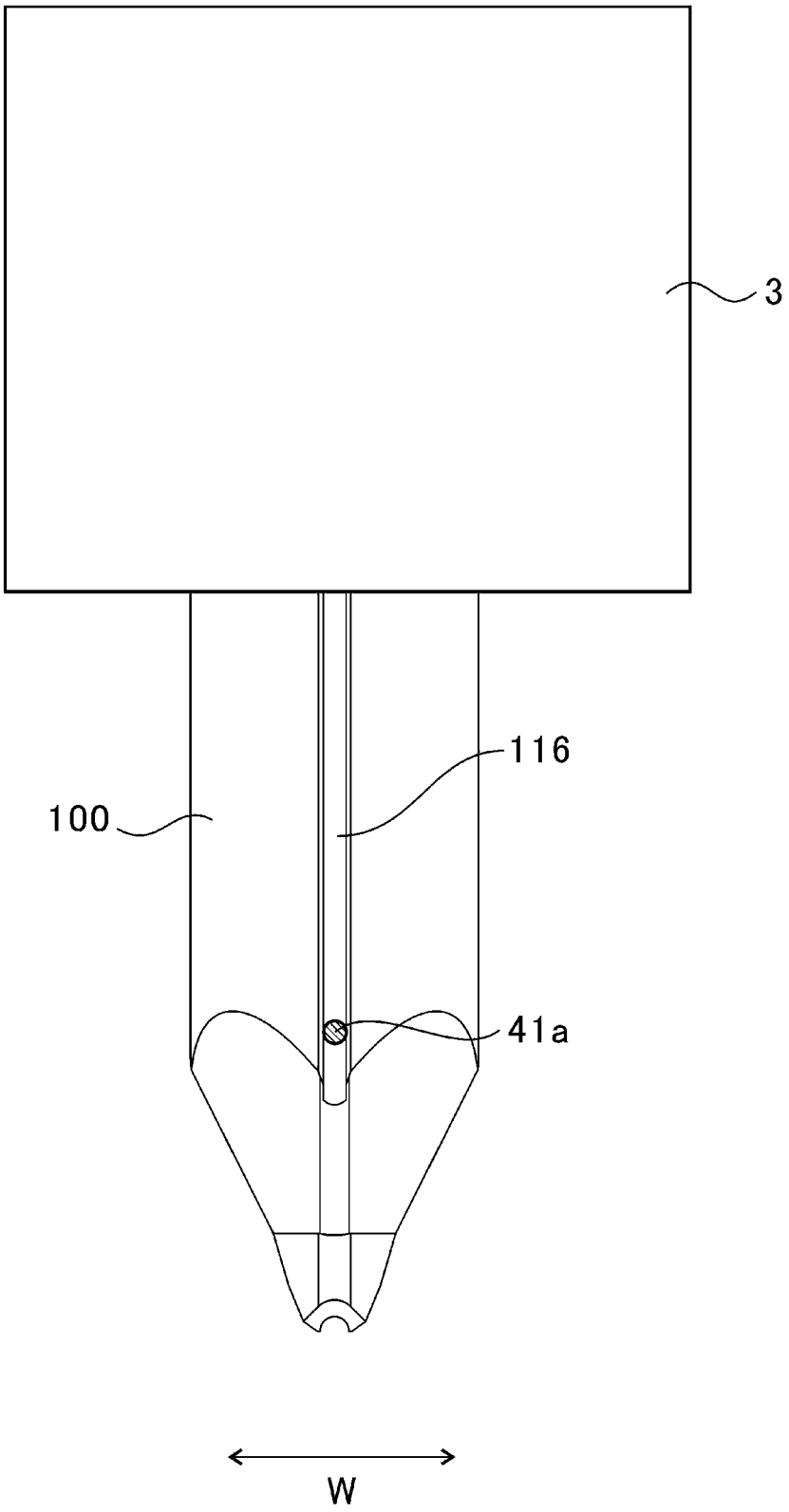
FIG. 13 is a view taken in a direction of an arrow XIII illustrated in FIG. 12.

FIG. 13 is a view taken in the direction of an arrow XIII illustrated in FIG. 12. In FIG. 13, the measuring instrument support 37 and the nozzle support 41 are not illustrated. As illustrated in FIG. 13, in the width direction W of the nozzle body 100, a width (a diameter) of the locating pin 41*a* is substantially the same as a width of the engaging groove 116. Accordingly, when the locating pin 41*a* and the engaging groove 116 are engaged to each other, the movement of the nozzle body 100 in the width direction W becomes restricted. When the locating pin 41*a* and the engaging groove 116 are engaged to each other, the nozzle body 100 can move only in the direction in which the engaging groove 116 extend (in other words, in the longitudinal direction of the nozzle body 100).

When the nozzle body 100 moving in the longitudinal direction of the nozzle body 100 is coupled to the seal gun 3, the movement in the longitudinal direction of the nozzle body 100 becomes restricted. Furthermore, the movement of the nozzle body 100 in a circumferential direction (about the central axis) of the nozzle body 100 becomes restricted by the locating pin 41*a*. As described above, the locating pin 41*a* is capable of restricting the rotation of the nozzle body 100 about the central axis after the nozzle body 100 has been coupled to the seal gun 3.

According to the present embodiment, the nozzle body 100 includes the elliptical passage 25*ac* (the discharge port 106 with a substantially elliptical shape) and the cutout groove 110. Compared with a circular passage in which the widths are the same in the short direction, the elliptical passage 25*ac* can increase the passage cross-sectional area. With the above, the pipeline resistance when the sealant S flows through the elliptical passage 25*ac* can be made smaller than the pipeline resistance of a circular passage in which the widths in the short direction are the same. By reducing the pipeline resistance, control of the discharge amount of the sealant S becomes easier. As a result, the workability in applying the sealant S can be improved.

When the nozzle body 100 moves forwardly in the advancing direction F while discharging the sealant S, the cutout groove 110 forms the bicone shaped portion Sa. The bicone shaped portion Sa adheres to the corner between the first applied member 202 and the second applied member 204. In other words, the nozzle body 100 of the present embodiment can increase the adhesion of the sealant S applied to the corner between the first applied member 202 and the second applied member 204. With the above, bubbles will not be easily mixed in the sealant S formed on the object T.

Furthermore, the shaping portion 112 squashes the bicone shaped portion Sa formed with the cutout groove 110. By having the shaping portion 112 squash the bicone shaped portion Sa, the sealant S can be shaped so as to have a target sealing cross-sectional shape. In other words, by including the shaping portion 112, the nozzle body 100 will not need the shaping process of shaping the sealant S, which has been applied on the object T, with a spatula member. As described above, the nozzle body 100 of the present embodiment can improve the workability in applying the sealant S on the object T.

A description has been given with reference to the accompanying drawings; however, it goes without saying that the present disclosure is not limited to the above embodiment. It is apparent to those skilled in the art that various modifications or amendments can be perceived within the scope of the claims, and it goes without saying that it is understood that the above modifications and amendments are within the technical scope of the present disclosure.

In the embodiment described above, the cutout groove 110 has been described, as an example, to have a substantially U-shape. However, not limited to the above, the cutout groove 110 may have other shapes such as, for example, a substantially V-shape.

In the embodiment described above, the nozzle body 100 has been described, as an example, to include the shaping portion 112. However, not limited to the above, the nozzle body portion 100 does not have to include the shaping portion 112.

In the embodiment described above, the nozzle body 100 has been described, as an example, to include the nozzle positioning portion 108. However, not limited to the above, the nozzle body 100 does not have to include the nozzle positioning portion 108.

In the embodiment described above, the nozzle body 100 has been described, as an example, to include the excessive seal leveling portion 114. However, not limited to the above, the nozzle body portion 100 does not have to include the excessive seal leveling portion 114.

In the embodiment described above, the nozzle body 100 has been described, as an example, to include the engaging groove 116 that engages with the locating pin 41*a*. However, not limited to the above, the nozzle body portion 100 does not have to include the engaging groove 116. For example, the nozzle body 100 may include the locating pin 41*a*, and the nozzle support 41 may include the engaging groove 116.

The present disclosure is capable of improving the workability in applying the sealant.

The invention claimed is:

1. A sealant discharging nozzle comprising:

a nozzle body;

a through hole provided in the nozzle body, the through hole extending along a central axis of the nozzle body;

a discharge port that is an opening of the through hole provided in an end surface of the nozzle body, the discharge port having a first width in a first direction orthogonal to the central axis and a second width in a second direction orthogonal to the central axis of the nozzle body and the first direction, the second width being smaller than the first width;

a cutout formed on a first side in the first direction with respect to the discharge port;

a nozzle positioning portion that comprises a first pair of tapered surfaces disposed on opposite sides of the discharge port, respectively, in the second direction, the first pair of tapered surfaces being inclined against the central axis of the nozzle body so that a gap between the first pair of tapered surfaces becomes larger as the first pair of tapered surfaces become separated from the discharge port;

an excessive seal leveling portion that comprises a second pair of tapered surfaces abutting the first pair of tapered surfaces and disposed on opposite sides of the nozzle positioning portion, respectively, in the second direction, the second pair of tapered surfaces having inclined angles against the central axis of the nozzle body being smaller than those of the first pair of tapered surfaces disposed on opposite sides of the discharge port in the second direction; and a third pair of tapered surfaces disposed on the first side of the discharge port in the first direction with respect to the cutout so that a gap between the third pair of tapered surfaces becomes larger toward a second side of the discharge port in the first direction, the second side being opposite the first side, wherein first ends on the discharge port side of the nozzle body in a direction along a central axis of the third pair of tapered surfaces are connected with the cutout, and second ends of the third pair of tapered surfaces on opposite sides in the second direction are connected with the excessive seal leveling portion.

2. The sealant discharging nozzle according to claim 1, further comprising:

a substantially planar portion that is, with respect to the discharge port, formed on the second side, the substantially planar portion disposed so as to be inclined at substantially forty-five degrees against a longitudinal direction of the nozzle body.

3. A sealant discharging apparatus comprising:

the sealant discharging nozzle according to claim 1;

a seal gun to and from which the sealant discharging nozzle is attachable and detachable;

a robot arm coupled to the seal gun; and an engaging pin configured to be attached to the seal gun, the engaging pin being capable of engaging with an engaging groove of the sealant discharging nozzle.

4. A sealant discharging apparatus comprising:

the sealant discharging nozzle according to claim 2;

a seal gun to and from which the sealant discharging nozzle is attachable and detachable;

a robot arm coupled to the seal gun; and an engaging pin configured to be attached to the seal gun, the engaging pin being capable of engaging with an engaging groove of the sealant discharging nozzle.

5. The sealant discharging apparatus according to claim 3, wherein the sealant discharging nozzle is configured to be held by the seal gun while being inclined to a side opposite to an advancing direction of the robot arm.

6. The sealant discharging apparatus according to claim 4, wherein the sealant discharging nozzle is configured to be held by the seal gun while being inclined to a side opposite to an advancing direction of the robot arm.

* * * * *